United States Patent [19]

Maari

[11] 4,106,146

[45] Aug. 15, 1978

[54] CONNECTING ARRANGEMENT BETWEEN A FLOATING STRUCTURE AND AN ANCHOR

[75] Inventor: Roger Maari, Roquebrune Cap Martin, France

[73] Assignee: Single Buoy Moorings Inc., Fribourg, Switzerland

[21] Appl. No.: 768,894

[22] Filed: Feb. 15, 1977

[30] Foreign Application Priority Data

Oct. 29, 1976 [NL] Netherlands ..... 7612046

[51] Int. Cl.[2] ..... B63B 21/52

[52] U.S. Cl. ..... 9/8 P; 114/230; 114/264

[58] Field of Search ..... 9/8 P; 114/230, 264, 114/265, 293; 141/387, 388

[56] References Cited

U.S. PATENT DOCUMENTS

| | | | |
|---|---|---|---|
| 3,383,870 | 5/1968 | Costello | 114/230 |
| 3,479,673 | 11/1969 | Manning | 114/230 |
| 3,519,036 | 7/1970 | Manning | 9/8 P |
| 3,700,014 | 10/1972 | Scales et al. | 9/8 P |
| 4,026,119 | 5/1977 | Dotti | 9/8 P |

FOREIGN PATENT DOCUMENTS

| | | | |
|---|---|---|---|
| 2,131,200 | 1/1972 | Fed. Rep. of Germany | 9/8 P |

*Primary Examiner*—Trygve M. Blix
*Assistant Examiner*—Stuart M. Goldstein
*Attorney, Agent, or Firm*—Young & Thompson

[57] ABSTRACT

A connecting arrangement between a floating installation such as a floating platform, and an anchor, comprises an upwardly extending rigid bar or rod connected at its lower end for vertical swinging movement about two perpendicular horizontal axes to an anchor. At its upper end, the rod or tube is connected universally to link means which in turn are connected to arms that are pivotally connected at a plurality of points to a floating platform, about spaced pivotal axes. The adjacent ends of the arms, to which the link means is connected, are preferably spaced apart a minimum horizontal distance.

7 Claims, 5 Drawing Figures

CONNECTING ARRANGEMENT BETWEEN A FLOATING STRUCTURE AND AN ANCHOR

The present invention relates to a connecting arrangement between a floating installation and an anchor, comprising an upwardly extending connecting means capable of being subjected to tension, its lower end being connected to an anchor by means of a joint having two perpendicular pivotal axes. The upper end of the connecting means is connected to an arm extending transversely to the connecting means and connected for rotational movement around the connecting means and for vertical swinging movement relative to the connecting means, whereby the arm effectively swings relative to the connecting means about horizontal and vertical axes perpendicular to each other. The other end of the arm, remote from the connecting means, is pivotally connected about a horizontal axis to the floating structure. The arm is buoyant.

Devices as thus far described are shown U.S. Pat. No. 4,031,582, the disclosure of which is incorporated herein by reference.

In the earlier patent, the floating structure is a vessel. The particular construction proposed in that earlier patent is, however, less suitable for connection to, for example, a floating platform whose floats are disposed below the water level, since the position of the upright connecting means, in relation to the head of the floating structure, shifts in a horizontal sense when the transverse arm pivots about its horizontal axis, as a result either of the difference in water level or of the anchor forces, so that the position of the connecting means in relation to the floating structure can be undesirable.

It is an object of the present invention to solve this problem, and to restrain the upper end of the connecting means to a minimum movement relative to the floating structure.

To achieve this object, the upwardly extending connecting means is coupled with the floating structure by means of arms that extend in different directions away from the connecting means and are hingedly connected with the floating structure. The ends of the arms adjacent the connecting means are each coupled with the connecting means via link means pivotally secured to the arms, for rotational movement about the connecting means and pivotal movement about two pivotal axes extending perpendicular to each other. The link means thus swings vertically about a horizontal axis that is perpendicular to the vertical extent of the connecting means, and also rotates about the axis of the elongated connecting means, and is pivotally connected to the adjacent ends of the arms for relative vertical swinging movement about a horizontal axis, the remote ends of the arms being pivotally connected to the floating structure for relative vertical swinging movement about horizontal axes. These horizontal axes of pivotal interconnection of the arms to the floating structure are spaced from each other, and may be parallel to each other or perpendicular to each other or arranged at other angles relative to each other.

The connecting means is thus connected to the floating structure in more than one direction, and in each direction via an arm and a link. As a result, not only does the head of the connecting means retain its position in relation to the floating structure almost exactly, but also the horizontal forces are distributed.

It has also been discovered that when the length of the links is less than the horizontal distance between the points of connection of the links to the arms, then the horizontal force components arising during relative movements of the connection means and the floating structure act in opposite directions. In this case, two opposing parts of the floating structure, coupled together as described, will be forced away from each other or pulled toward each other. But when the length of each link is longer than the horizontal distance between the points of pivotal connection of the links to the arms, then the horizontal force components are able to act in the same direction, which is preferable when these forces are large.

This desirable distribution of the forces is also achieved if the links associated with different arms are formed by a single bar which is connected at its center to the connecting means for vertical swinging movement relative to the length of the connecting means and for swivelling movement about the connecting means. In this latter case, the best arrangement is believed to be when the bar extends substantially vertically and the arms extend in a substantially horizontal direction. Then the horizontal forces on the not structure no only act in the same direction but also are of substantially equal magnitude.

These and other objects, features and advantages of the present invention will become apparent from a consideration of the following description, taken in connection with the accompanying drawings, in which.

Figure 1:
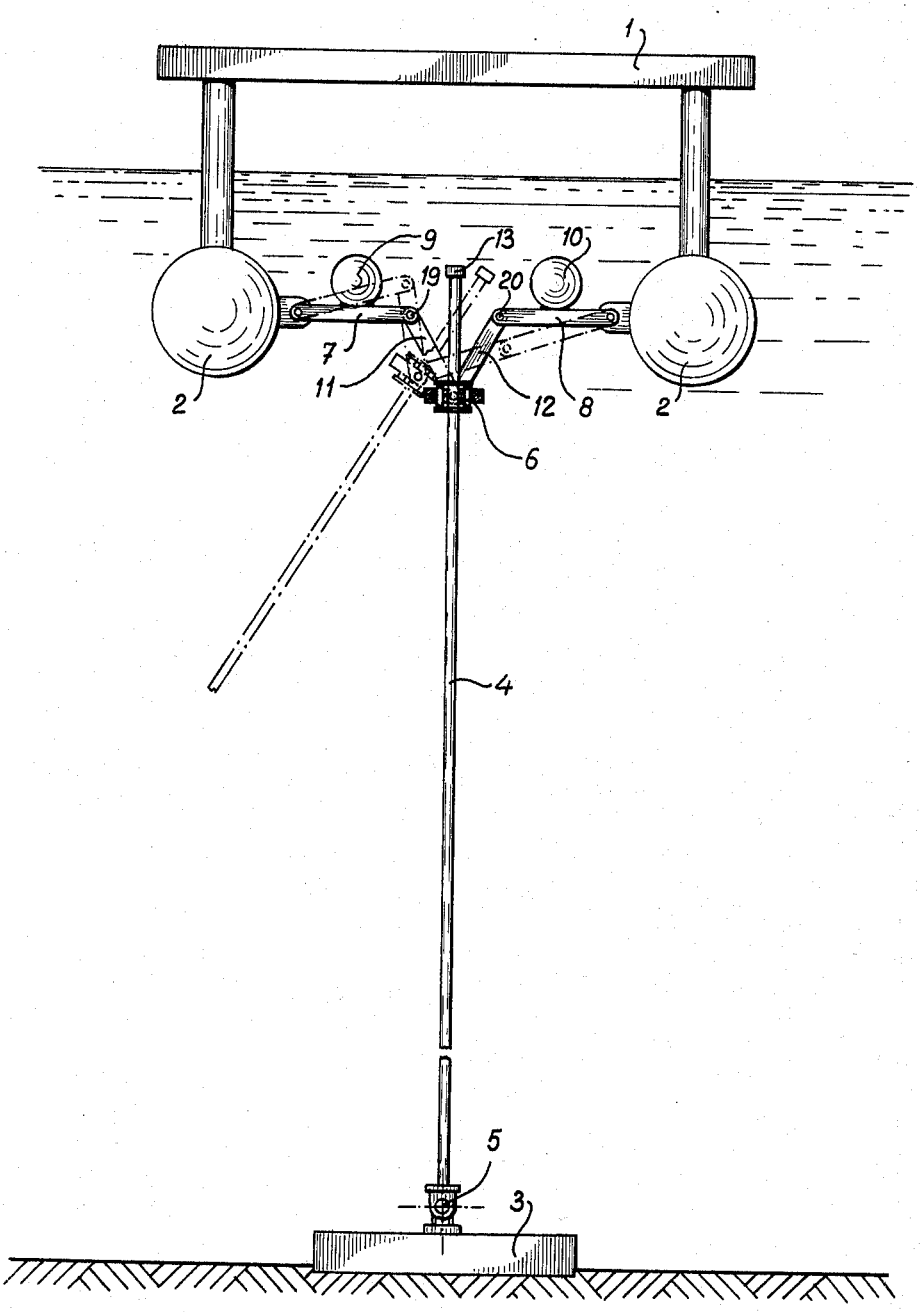
FIG. 1 is a somewhat schematic elevational view of apparatus according to the present invention, showing a first embodiment thereof.

Referring now to the drawings in greater detail, and first to the embodiment of FIG. 1, there is shown floating structure according to the present invention in the form of a floating platform 1 having substantially cylindrical floats 2 disposed below the water level and parallel to each other. On the sea bottom is an anchor 3 from which upwardly extending connecting means in the form of a rod or tube 4, which is substantially rigid and also torsion-stiff, extends upwardly. At its lower end, tube 4 is mounted for vertical swinging movement relative to anchor 3 about two perpendicular horizontal axes 5. Adjacent its upper end, tube 4 has a universal joint 6 that provides for vertical swinging movement of interconnected structure to be described, about a vertical axis defined by tube 4 and at least one horizontal axis perpendicular to that vertical axis.

Arms 7 and 8 are connected to floats 2 for relative vertical swinging movement about horizontal axes, the arms 7 and 8 being rendered buoyant by floats 9 and 10, respectively. Links 11 and 12 are pivotally interconnected to the inner or adjacent ends of arms 7 and 8, respectively, via horizontal pivots 19 and 20, respectively. At their other ends, links 11 and 12 are connected for vertical swinging movement about horizontal axes to the universal joint 6.

In FIG. 1, the full line position of the parts is that assumed when the structure is disposed vertically above anchor 3. But if the structure is not disposed vertically above anchor 3, then the position of the parts is shown in phantom line. The horizontal force components, brought about by the relative movement of the floats 2 in relation to the tube 4, act on these floats in opposite directions when the parts are dimensioned as in FIG. 1. The upper end 13 of the tube 4, however, is displaced only very slightly in a horizontal direction relative to floats 2.

In the arrangement of FIG. 1, the length of the links 11 and 12 can be and preferably is substantially greater than the horizontal distance between the hinge points 19 and 20. The best arrangement is when the distance between 19 and 20 is at a minimum. Then the horizontal forces on the floating installation act in the same direction and do not differ much in magnitude.

Figure 2:
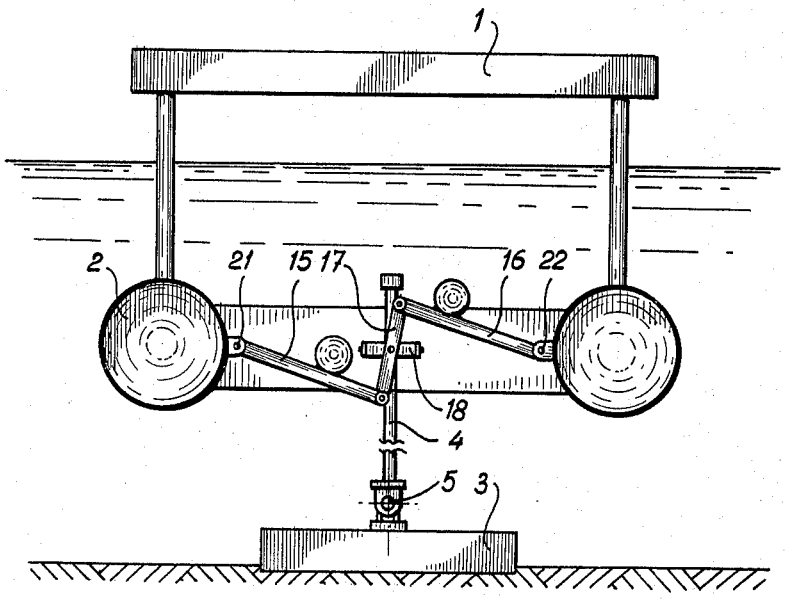
FIG. 2 is a view similar to FIG. 1 but showing a second embodiment.
Figure 3:
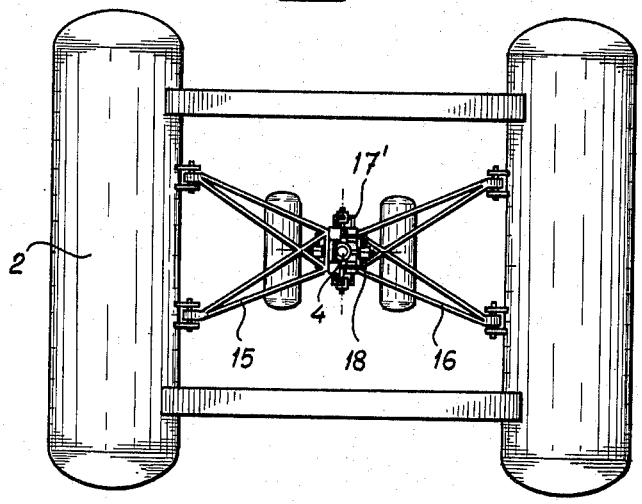
FIG. 3 is a bottom plan view of the embodiment of FIG. 2, with the anchor omitted.

The embodiment shown in FIGS. 2 and 3 differs from that shown in FIG. 1 in that the arms 15 and 16 are connected to each other via pivotal connctions to opposite ends of a single bar 17 in the form of a frame 17' shown in FIG. 3, which is secured to tube 4 through universal joint 18 for relative vertical swinging and 360° swivel movement about the axis of tube 4. The length of each arm 15 or 16 is about half the distance between the points 21, 22 where the arms 15 and 16 are connected to the floats 2.

It is also possible to distribute the arms peripherally about the tube 4 in various symmetrical arrangements, for example three arms forming an angle of 120° to each other, or four arms forming an angle of 90° to each other. Preferably, such an arrangment provides a uniform distribution of forces.

Figure 4:
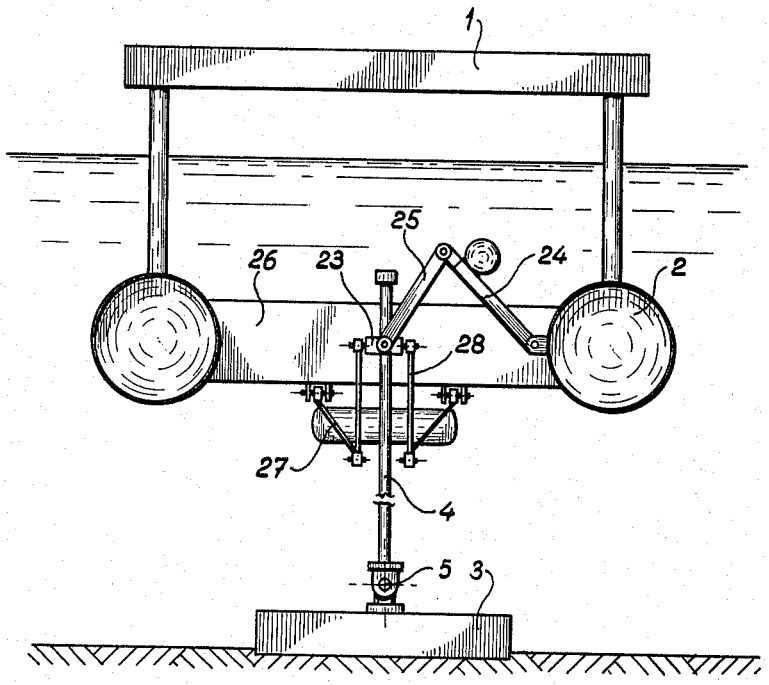
FIG. 4 is a view similar to FIGS. 1 and 2 but showing a third embodiment of the invention.
Figure 5:
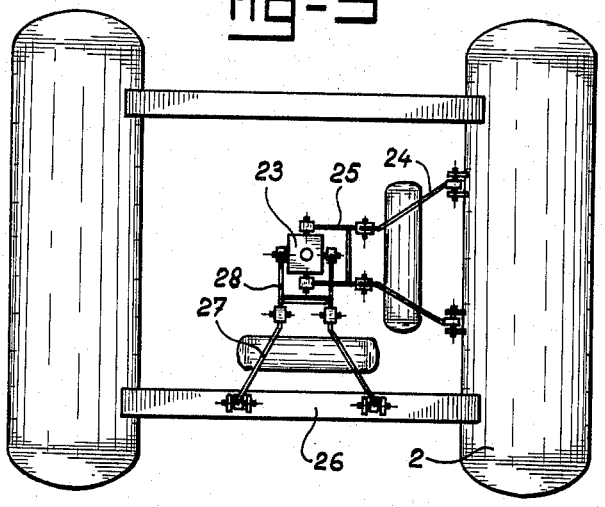
FIG. 5 is a view similar to FIG. 3 but of the embodiment of FIG. 4.

FIGS. 4 and 5 show an embodiment in which the tube 4 is connected in one direction through universal joint 23 to the float 2 by an upwardly inclined arm 24 and a link 25, and in a direction perpendicular thereto, to a crosspiece 26 via downwardly directed arm 27 and link 28. With an arrangement such as this, in which the axes of the arms form an angle with each other in a horizontal plane, the upper end of the tube 4 will remain in position relative to the floating structure regardless of the draft.

In view of the foregoing disclosure, therefore, it is evident that the initially recited object of the present invention has been achieved.

Although the present invention has been described and illustrated in connection with preferred embodiments, it is to be understood that modifications and variations may be resorted to without departing from the spirit of the invention, as those skilled in this art will readily understand. Such modifications and variations are considered to be within the purview and scope of the present invention as defined by the appended claims.

What is claimed is:

1. In a connecting arrangement between a floating structure and an anchor, comprising an upwardly extending connecting means connected at its lower end to an anchor by means of a pair of horizontal perpendicular pivot axes, and an arm extending transversely to the upwardly extending connecting means and having one end connected for vertical swinging movement about a horizontal axis to the floating structure and having an opposite end adjacent to and connected for swivelling movement about the upwardly extending connecting means; the improvement in which there are plural said arms extending in different directions away from the upwardly extending connecting means, said plural arms being connected to the floating structure for vertical swinging movement relative to each other about different horizontal axes, and links having one end pivotally interconnected to the ends of the arms adjacent the upwardly extending connecting means, for vertical swinging movement relative to each other and relative to said arms about different horizontal axes, and having opposite ends remote from said arms universally connected to said upwardly extending connecting means.

2. A connecting arrangement as claimed in claim 1, in which the links slope downwardly toward said upwardly extending connecting means.

3. A connecting arrangement as claimed in claim 1, in which the links of two differently directed arms are formed by a single bar which is connected at its center for universal movement relative to the first mentioned upwardly extending connecting means.

4. A connecting arrangement as claimed in claim 3, in which one position said single bar extends substantially vertically and said arms extend substantially horizontally.

5. A connecting arrangement as claimed in claim 1, in which the plural arms when viewed in plan are disposed at angles to each other that form at least one angle less than 180°.

6. A connecting arrangment as claimed in claim 5, in which the links associated with said arms are inclined in opposite vertical directions.

7. A connecting arrangement as claimed in claim 5, in which said angle is about 9°.

* * * * *